US005900595A

United States Patent [19]

Akima et al.

[11] Patent Number: 5,900,595

[45] Date of Patent: May 4, 1999

[54] INTAKE SILENCER DEVICE

[75] Inventors: Kazuhiro Akima; Jun Kitahara, both of Wako, Japan

[73] Assignee: Honda Giken Kogyo Kabushiki Kaisha, Tokyo, Japan

[21] Appl. No.: 09/116,939

[22] Filed: Jul. 17, 1998

[30] Foreign Application Priority Data

Jul. 22, 1997 [JP] Japan ..... 9-195448

[51] Int. Cl.[6] ..... F02M 35/00

[52] U.S. Cl. ..... 181/229; 181/272

[58] Field of Search ..... 181/229, 230, 181/255, 258, 269, 272; 55/385.3; 123/198 E

[56] References Cited

U.S. PATENT DOCUMENTS

| | | | |
|---|---|---|---|
| 4,136,756 | 1/1979 | Kawamura | 181/229 |
| 4,782,912 | 11/1988 | Wandless | 181/229 |
| 4,790,864 | 12/1988 | Kostun | 181/229 |

FOREIGN PATENT DOCUMENTS 2-196157 8/1990 Japan .

*Primary Examiner*—Khanh Dang

*Attorney, Agent, or Firm*—Nikaido, Marmelstein, Murray & Oram LLP

[57] ABSTRACT

An expandable chamber functioning as an expandable silencer, an air cleaner chamber functioning as an expandable silencer and a resonator chamber functioning as a resonant silencer are integrally formed in a main body of an intake silencer device. The air cleaner chamber and the resonator chamber communicate with each other through a communicating portion. A first intake duct is provided with one end extending into the expandable chamber and with the other end communicating with the atmosphere. A second intake duct is provided with one end extending into the expandable chamber opposed to one end of the first intake duct and with the other end extending into the air cleaner chamber. A third intake duct is provided with one end extending into the air cleaner chamber and connected to an air filter element. Thus, an intake silencer device has a high silencing effect, while being compact, and in which the rising of the temperature of an intake air and an increase in resistance to the flow of the intake air can be prevented.

12 Claims, 7 Drawing Sheets

INTAKE SILENCER DEVICE

BACKGROUND OF THE INVENTION

1. Field of the Invention

The present invention relates to an intake silencer device which is formed integrally with an air cleaner and disposed upstream of a throttle body, in an intake passage in an engine.

2. Description of the Related Art

An intake silencer device integrally combined with an air cleaner mounted in an intake passage in an engine, is known from Japanese Patent Application Laid-Open No. 2-196157. In this intake silencer device, a side branch functioning as a resonant silencer is integrally defined in the air cleaner functioning as an expandable silencer, thereby reducing the noise of a lower frequency, while suppressing an increase in noise of a medium frequency.

The known intake silencer device includes Helmholtz-type silencers in an intake passage between the air cleaner and a throttle body and in a surge tank downstream of the throttle body, respectively, in addition to the side branch provided integrally with the air cleaner. When the plurality of silencers are disposed in the intake passage in the above dispersed manner, the entire intake silencer device is large-sized, resulting not only in an increased number of parts, but also in the possibility that the layout of the intake silencer device within a narrow engine compartment may be difficult. Moreover, the surface area of the entire intake silencer device is increased and liable to receive the heat of the engine. For this reason, the temperature of intake air passing through the intake silencer device is raised, and the resistance to the flow of the intake air is increased by the plurality of silencers disposed in the dispersed manner, resulting in the possibility that the engine power output may be reduced.

SUMMARY OF THE INVENTION

Accordingly, it is an object of the present invention to provide an intake silencer device which has a high silencing effect, while being compact, and in which the rising of the temperature of the intake air and the increase in the resistance to the flow of the intake air can be prevented.

To achieve the above object, according to the present invention, there is provided an intake silencer device disposed upstream of a throttle body in an intake passage of an engine, the silencer device being integrally provided with an air cleaner. The intake silencer device comprises an expandable chamber, a first intake duct having one end extending into the expandable chamber and communicating at the other end with the atmosphere, and an air cleaner chamber which is defined integrally with the expandable chamber and in which an air filter element is accommodated. A second intake duct extends at one end into the expandable chamber and at the other end into the air cleaner chamber, and a third intake duct extends at one end into the air cleaner chamber and is connected at the one end to air filter element and at the other end to the throttle body. A resonator chamber which is defined integrally with the air cleaner chamber, communicates with the air cleaner chamber and the expandable chamber, and the resonator chamber is integrally defined on opposite sides of the air cleaner chamber. An opening at the one end of the first intake duct and an opening at the one end of the second intake duct are opposed to each other with a gap left therebetween within the expandable chamber, an opening at the other end of the second intake duct is disposed in an offset manner above and to one side of the element within the air cleaner chamber, and the other end of the third intake duct is connected to the throttle body through the upper surface of the resonator chamber defined with its upper surface lower in level than the air cleaner chamber.

With the above arrangement, the expandable chamber, the air cleaner chamber and the resonator chamber are defined integrally with one another and therefore, the intake silencer device including the air cleaner can be constructed in a compact manner. This results not only in the facilitation of the arrangement of the intake silencer device within the engine compartment and the operation of mounting and dismounting the intake silencer device into and from the engine compartment, but also in reduction of weight and cost of the intake silencer device. Moreover, the surface area of the entire silencer device can be suppressed to the minimum, to thereby prevent the raising of the temperature of the intake air due to the heat of the engine. In addition, four resonant silencers are formed by extensions of the first, second and third intake ducts extending into the expandable chamber and the air cleaner chamber, in addition to the expandable chamber and the air cleaner chamber each functioning as an expandable silencer and the resonator chamber functioning as a resonant silencer. Therefore, the noise in a wide range from a lower frequency to a higher frequency can be effectively reduced. Further, the opening at the one end of the first intake duct and the opening at the one end of the second intake duct are opposed to each other with the gap left therebetween within the expandable chamber and therefore, the intake air is allowed to flow smoothly from the first intake duct to the second intake duct, and the resistance to the flow of the intake air can be reduced. Further, since the opening at the other end of the second intake duct is disposed in an offset manner above and to one side of the element, a revolving flow can be generated within the air cleaner chamber, to prevent a partial fouling of the air filter element. Yet further, since the other end of the third intake duct is connected to the throttle body through a position above the resonator chamber which is shorter in height than the air cleaner chamber, any upward projection of the third intake duct can be prevented, to thereby reduce the vertical dimension of the intake silencer device.

The above and other objects, features and advantages of the invention will become apparent from the following description of the preferred embodiment taken in conjunction with the accompanying drawings.

BRIEF DESCRIPTION OF THE DRAWINGS

FIGS. 1 to 7 show an embodiment of the present invention, wherein:

FIG. 1 is a plan view of an engine compartment in an automobile incorporating the embodiment.

FIG. 2 is an enlarged sectional view taken along a line 2—2 in FIG. 1.

FIG. 3 is an enlarged sectional view taken along a line 3—3 in FIG. 2.

FIG. 4 is a view taken in a direction of an arrow 4 in FIG. 2.

FIG. 5 is a exploded perspective view of an intake silencer device.

FIG. 6 is a schematic diagram of the intake silencer device.

FIG. 7 is a diagram showing an acoustic model for the intake silencer device.

DETAILED DESCRIPTION OF THE PREFERRED EMBODIMENTS

Figure 1:
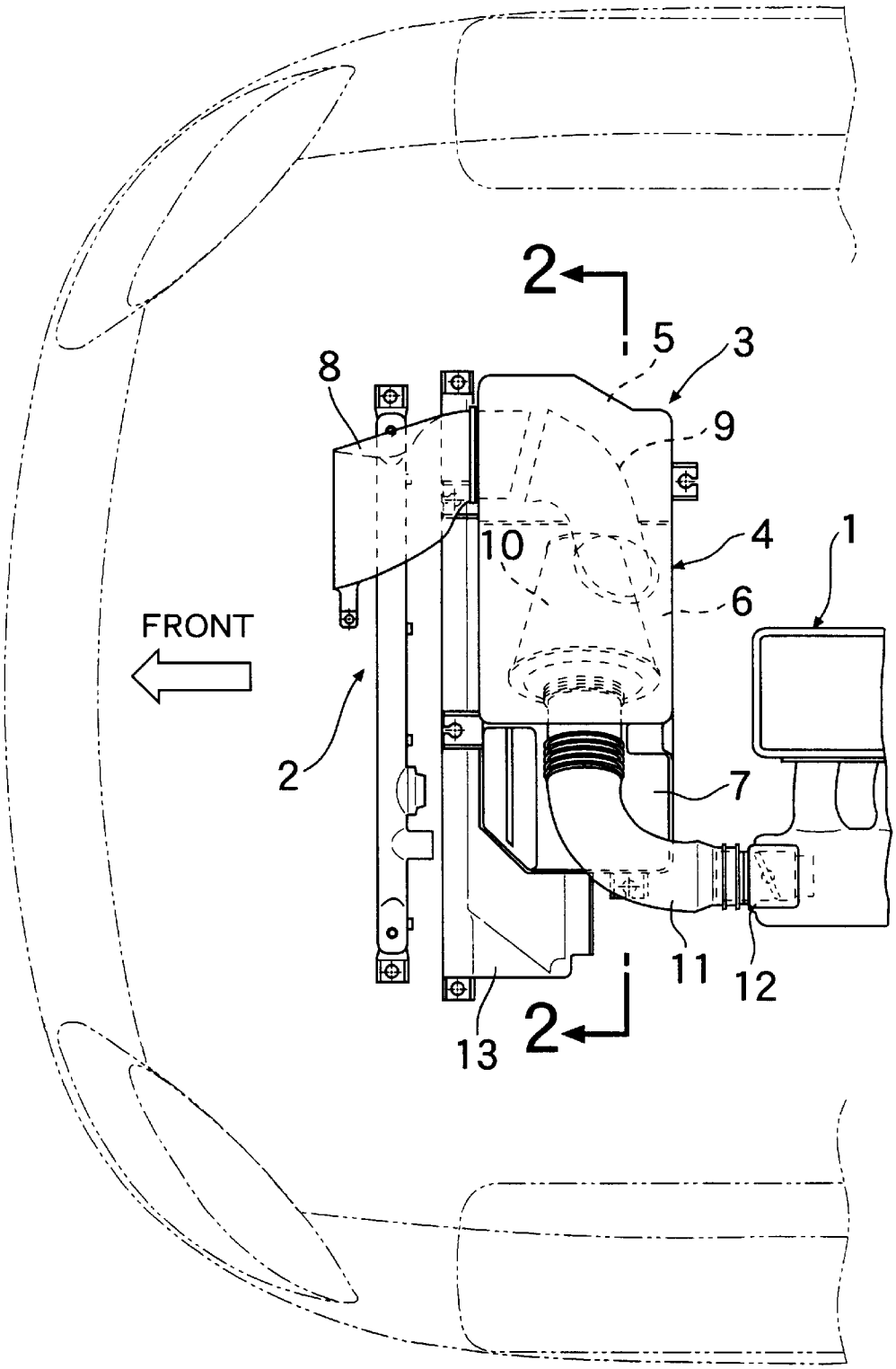

Referring to FIG. 1, an intake silencer device 3 integrally provided with an air cleaner AC, is disposed between an engine 1 mounted at a front portion of a vehicle body of an automobile and a radiator 2 mounted in front of the engine 1. A main body 4 of the intake silencer device 3, is integrally provided with an expandable chamber 5 located at a right portion of the vehicle body, an air cleaner chamber 6 located at a central portion of the vehicle body, and a resonator chamber 7 located at a left portion of the vehicle body. The interior of the expandable chamber 5, communicates with the atmosphere through a first intake duct 8 extending forward of the vehicle body beyond the radiator 2 and also communicates with the interior of the air cleaner chamber 6 through a second intake duct 9 bent in an L-shape as viewed in a plan view. A truncated conical air filter element 10 located in the air cleaner chamber 6, is connected to a throttle body 12 mounted at a front portion of the engine 1, through a third intake duct bent in an L-shape as viewed in a plan view.

The structure of the intake silencer device 3 will be described below with reference to FIGS. 2 to 5.

The main body 4 of the intake silencer device 3 is comprised of a lower member 21 with its upper surface opened and an upper member 22 with its lower surface opened. The lower and upper members 21 and 22 are coupled to each other through seal members 23 and 24. The expandable chamber 5 is defined at the right end of the main body 4 by partition walls $\mathbf{21}_1$ and $\mathbf{22}_2$ formed on the lower and upper members 21 and 22, respectively. The first intake duct 8 formed relatively flat vertically, includes a grooved flange $\mathbf{8}_1$ around the outer periphery and is supported on the main body 4 by fitting the flange 81 into notches $\mathbf{21}_2$ and $\mathbf{22}_2$ defined in the lower and upper members 21 and 22. The first intake duct 8 also includes a mounting portion $\mathbf{8}_2$, extending in a forward direction of the vehicle body from the main body 4. The mounting portion $\mathbf{8}_2$ is bolted in place on the vehicle body.

Notches $\mathbf{21}_3$ and $\mathbf{22}_3$ are defined in partition walls $\mathbf{21}_1$ and $\mathbf{22}_1$ which separate the expandable chamber 5 and the air cleaner chamber 6 from each other. Thus, the second intake duct 9 is supported by fitting a grooved flange $\mathbf{9}_1$ formed around an outer periphery of the second intake duct 9, into the notches $\mathbf{21}_3$ and $\mathbf{22}_3$. The second intake duct 9 extending into the expandable chamber 5 is formed relatively flat vertically and has an opening $\mathbf{9}_2$ which is opposed to an opening $\mathbf{8}_3$ in the first intake duct 8 with a slight gap 25 formed therebetween.

The third intake duct 11 is supported by fitting a grooved flange $\mathbf{11}_2$ formed around an outer periphery of the third intake duct 11, in the vicinity of an opening $\mathbf{11}_1$ in the third intake duct 11, into notches $\mathbf{21}_4$ and $\mathbf{22}_4$ defined in the lower and upper members 21 and 22. The air filter element 10 press-fitted in the tip end of the third intake duct 11, has a pin $\mathbf{10}_1$ which is provided at its tip end and is locked to a rubber mount 26 provided at the bottom wall of the lower member 21 (see FIG. 2). The air filter element 10 formed into a truncated conical shape, is disposed obliquely, so that its generating line extends along the bottom wall of the lower member 21. An opening $\mathbf{9}_3$ cut obliquely in the second intake duct 9 faces a triangular space (see FIG. 2) defined between an upper portion of the air filter element 10 and a ceiling surface of the upper member 22. Namely, the opening $\mathbf{9}_3$ in the second intake duct 9 is offset upwards with respect to the air cleaner AC and rearwards of vehicle body.

Thus, the above-described positioning of the air filter element 10 and the second intake duct 9, ensures that the vertical and lateral dimensions of the air cleaner chamber 6 are reduced, and that intake air flowing from the second intake duct 9 into the air cleaner chamber 6, becomes a revolving flow and is equally drawn from the entire surface of the air filter element 10. Therefore, partial fouling of the air filter element 10 can be prevented, whereby the life of the air filter element 10 can be prolonged and a reduction in function of the air filter element 10 can be avoided.

Figure 2:
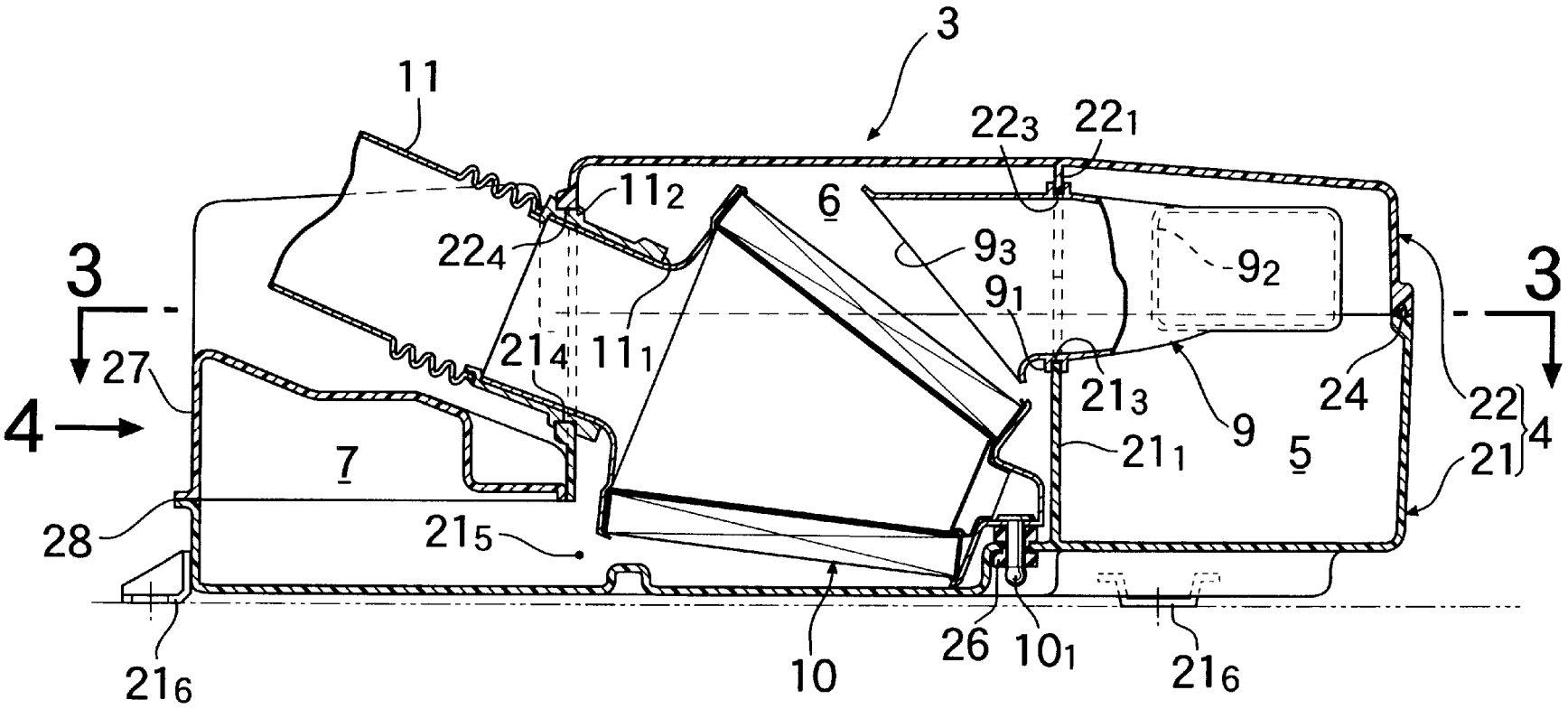

The resonator chamber 7 is defined by coupling an opening in the upper surface of the lower member 21 and an opening in the lower surface of a cover member 27 on a mating surface 28, and has an internal space which communicates with an internal space in the air cleaner chamber 6 through a communicating portion $\mathbf{21}_5$ (see FIG. 2). The level of the upper surface of the cover member 27 is lower than the level of the upper surface of the upper member 22. The third intake duct 11 extending in a left direction from the air cleaner chamber 6, is curved rearwards through the space above the cover member 27 and is connected to the throttle body 12 of the engine E. Thus, the vertical and lateral dimensions of the intake silencer device 3 can be reduced by positioning the third intake duct 11 utilizing the space above the short resonator chamber 7, in the above manner.

Four brackets $\mathbf{21}_6$ are provided on the lower member 21. The intake silencer device 3 is supported in an engine compartment by fastening the two front mounting brackets $\mathbf{21}_6$ to an air guide plate 13 of the radiator 2 by bolts 14 (see FIG. 5) and bolting the two rear brackets $\mathbf{21}_6$ to a mounting portion which is not shown.

The operation of the embodiment of the present invention having the above-described arrangement will be described below.

Figure 6:
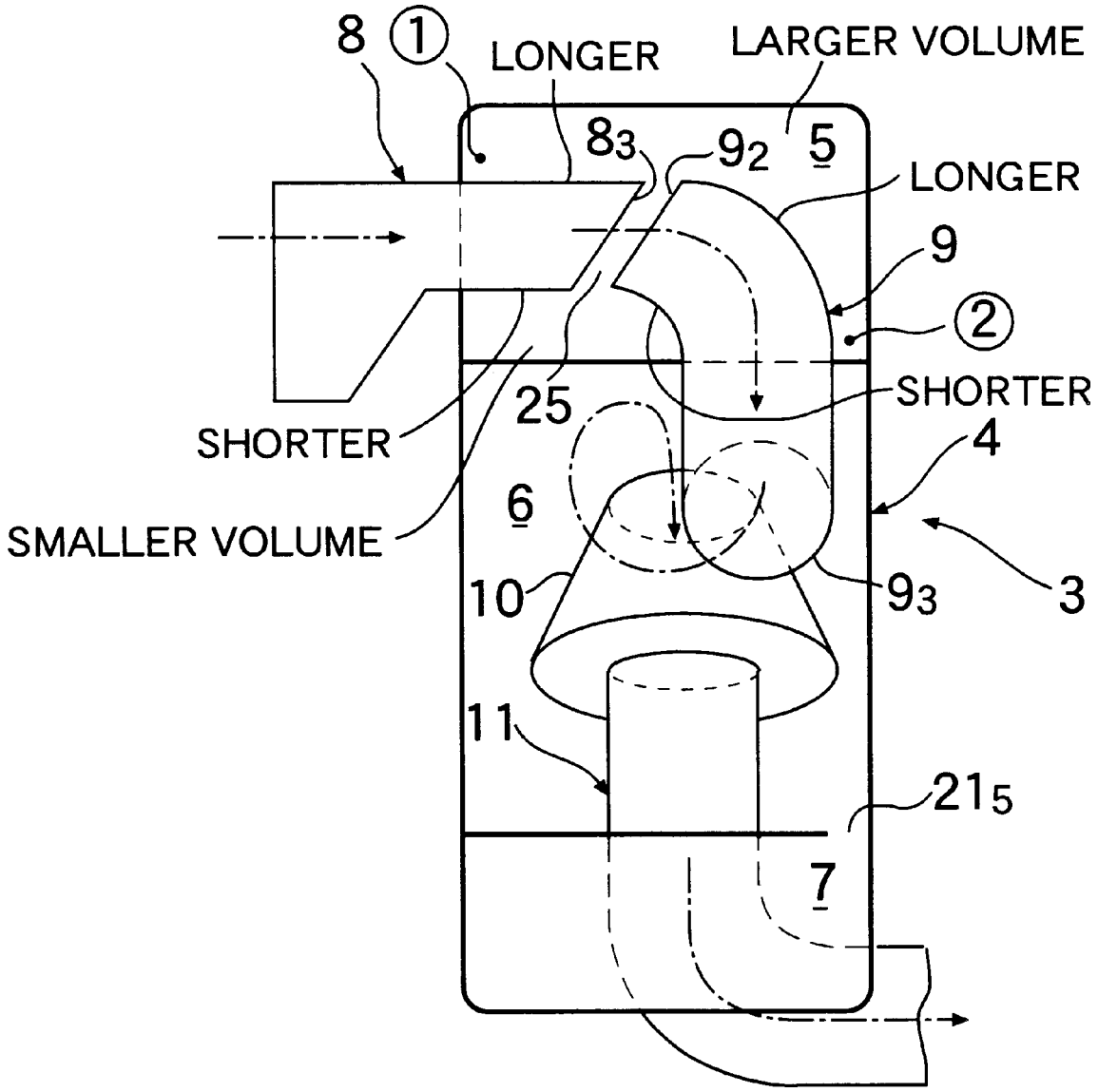
Figure 7:
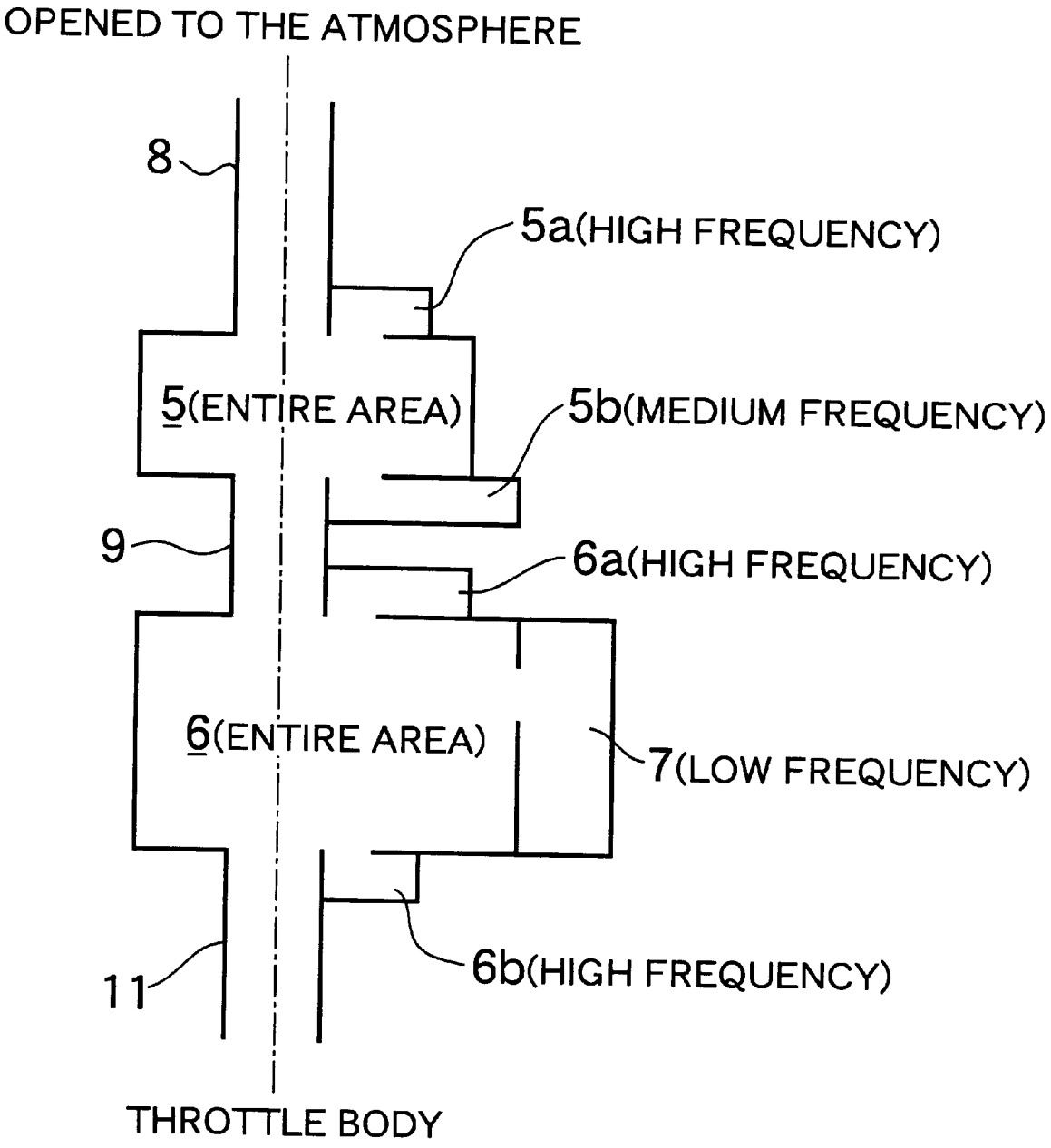

FIG. 6 is a schematic diagram showing the skeleton structure of the intake silencer device 3 according to this embodiment, and FIG. 7 represents the skeleton structure as an acoustic model. One end of the first intake duct 8 extends into the expandable chamber 5 and hence, a first phantom side branch 5*a* is formed as the extension. Likewise, a second side branch 5*b* is formed as an extension of the second intake duct 9 into the expandable chamber 5; a third side branch 6*a* is formed as an extension of the second intake duct 9 into the air cleaner chamber 6, and a fourth side branch 6*b* is formed as an extension of the third intake duct 11 into the air cleaner chamber 6. The intake silencer device 3 according to this embodiment includes a total of seven silencing chambers: the first, second, third and fourth side branches 5*a*, 5*b*, 6*a* and 6*b* each functioning a resonant silencer in addition to the expandable chamber 5 functioning as an expandable silencer, the air cleaner chamber 6 likewise functioning as an expandable silencer, and the resonator chamber 7 functioning as a resonant silencer.

As shown in FIG. 7, the resonator chamber 7 exhibits a silencing effect for a lower frequency range by the resonator effect provided by a Helmholtz resonator, and the expandable chamber 5 and the air cleaner chamber 6 each having a larger volume exhibit a silencing effect for the entire frequency range. Each of the first, second, third and fourth side branches 5*a*, 5*b*, 6*a* and 6*b* exhibits a silencing effect in the following manner. A stationary wave of a medium/high frequency depending on the size and shape of the expandable chamber 5 and the air cleaner chamber 6 is generated in the chambers 5 and 6. The stationary wave alternately has an antinode of a higher sound pressure (a site where the amplitude is maximum), and a node of a lower sound pressure (a site where the amplitude is minimum). Therefore, the sound corresponding to the frequency of the stationary wave can be damped by regulating the extension amount of the first, second and third intake ducts 8, 9 and 11 and opening the ends thereof at the location of such node.

The opening 83 in the first intake duct 8 and the opening 92 in the second intake duct 9 are located coaxially with each other and in an opposed relation to each other within the expandable chamber 5. Therefore, the loss in pressure provided when the intake air flows from the first intake duct 8 to the second intake duct 9, can be suppressed to the minimum, thereby providing an increase in engine output power and a reduction in noise of the intake air.

As shown in FIG. 6, the first and second intake ducts 8 and 9 are curved at approximately right angles within the expandable chamber 5. A space having a smaller volume is defined inside the curved positions, or curvature (at a location near the air cleaner chamber 6), and a space having a larger volume is defined outside the curvature (at a location far from the air cleaner chamber 6). The opening $\mathbf{8}_3$ in the first intake duct 8 and the opening $\mathbf{9}_2$ in the second intake duct 9 are cut obliquely, and the amount of extension of the first and second intake ducts 8 and 9 into the expandable chamber 5 are shorter on the inside of the curvature and longer on the outside of the curvature.

Thus, when a stationary wave is generated in the larger-volume space in the expandable chamber 5, the locations (1) and (2) adjacent the wall surface of the expandable chamber 5 correspond to antinodes of the stationary wave and hence, the sound pressure is higher at the locations (1) and (2). However, both of the amount of extension of the first intake duct 8 from the location (1) and the amount of extension of the second intake duct 9 from the location (2) are longer and hence, the intake ducts 8 and 9 are opened at the locations of the lower sound pressure near the nodes of the stationary wave, whereby the noise is effectively reduced.

Figure 3:
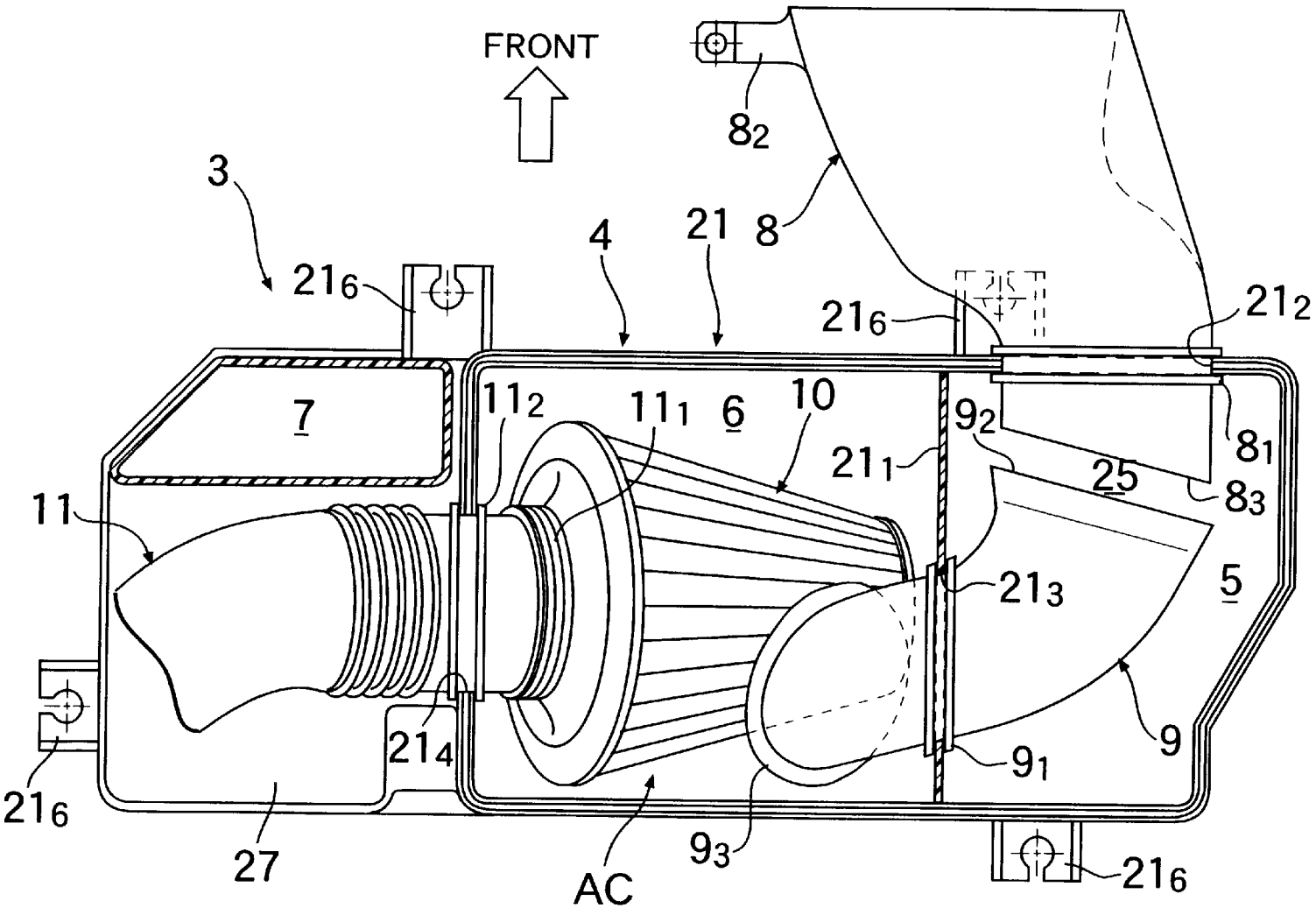
Figure 4:
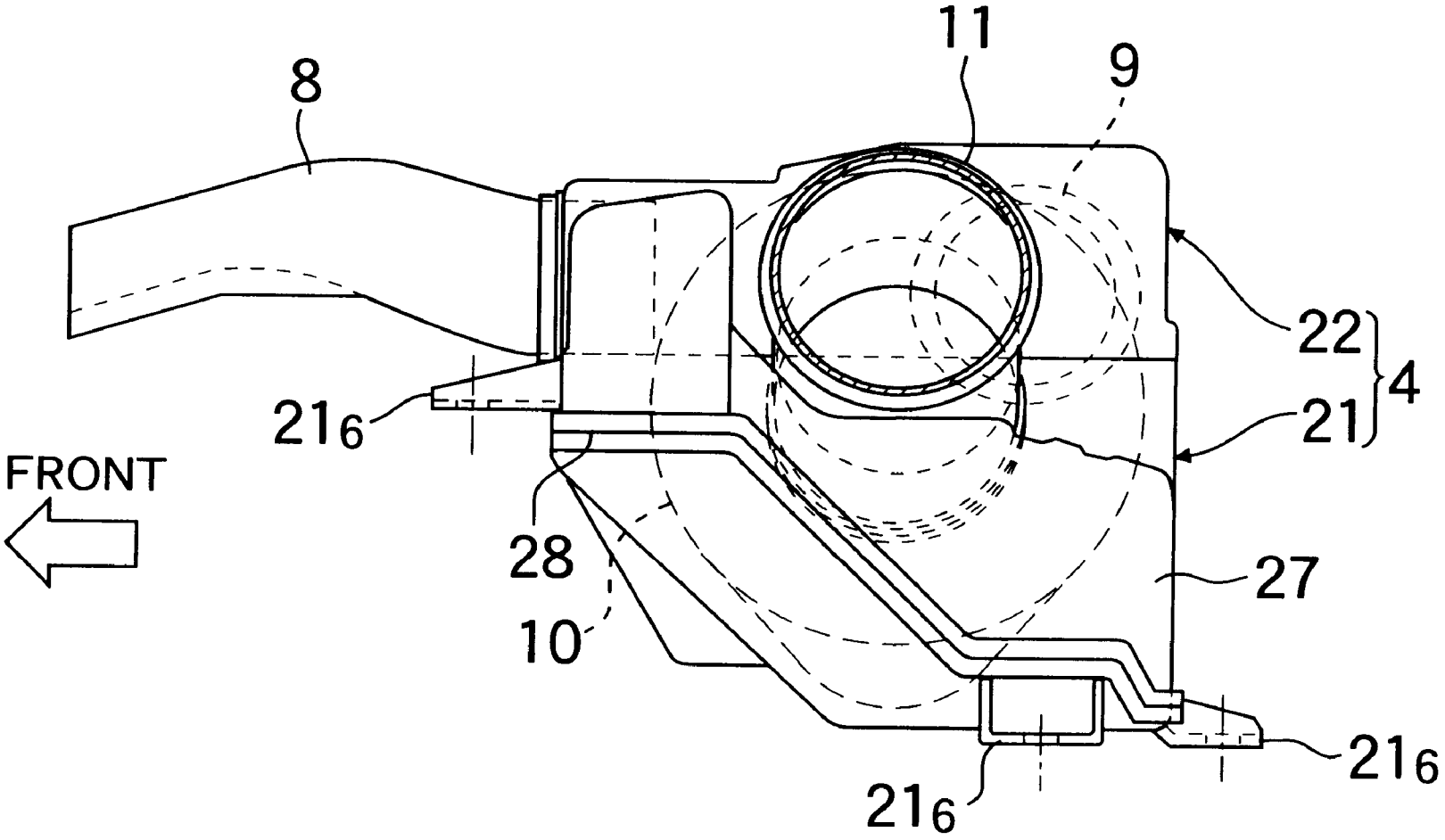
Figure 5:
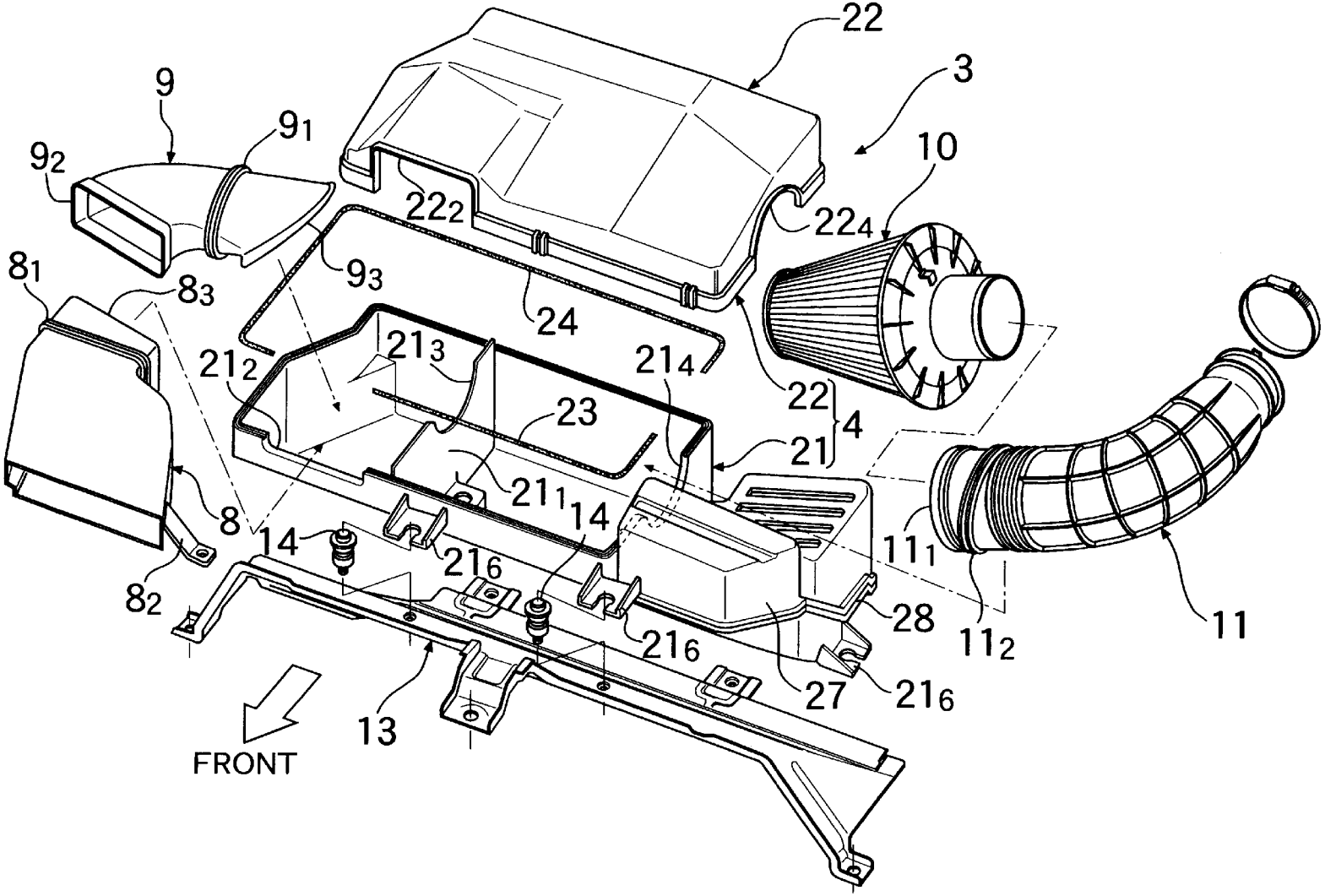

As can be seen from FIG. 3, the expandable chamber 5 and the resonator chamber 7 are defined into a substantially pentagonal shape as viewed in a plan view, and as can be seen in FIG. 4, the main body 4 of the silencer device 3 (i.e., the expandable chamber 5, the air cleaner chamber 6 and the resonator chamber 7) is also formed into a substantially pentagonal shape as viewed in a side view. When the sound waves reflected between the opposed wall surfaces interfere with each other to generate a stationary wave, the stationary wave is strongest when the opposed wall surfaces are disposed in parallel to each other, and the stationary wave is weakest when the wall surfaces are annular. However, the formation of the wall surfaces of the chambers 5, 6 and 7 into an annular shape is inconvenient for effectively utilizing the space and hence, is not realistic. Therefore, in the present embodiment, the apex of one of the wall surfaces forming a quadrilateral shape is cut to form wall surfaces forming a pentagonal shape, wherein the fifth wall surface formed by the cutting is disposed in a non-parallel relationship to the other wall surfaces. This ensures that the wall surfaces opposed to each other can be reduced, while keeping the wastefulness of the space to the minimum, thereby inhibiting the generation of a stationary wave to effectively reduce the noise.

Since the expandable chamber 5, the air cleaner chamber 6 and the resonator chamber 7 are integrally defined in the common main body 4, as described above, the entire intake silencer device 3 including the air cleaner is made compact. This results in the facilitation of the arrangement of the intake silencer device 3 within the engine compartment and the operation for mounting and removing the intake silencer device 3 into and out of the engine compartment, but also contributes to reductions in weight and cost of the intake silencer device 3. Moreover, the surface area of the entire intake silencer device 3 can be kept to the minimum to prevent the rising of the temperature of the intake air due to the heat of the engine 1. The noise in a wide range of from a low frequency to a high frequency can be reduced by the total of seven silencing chambers: the expandable chamber 5, the air cleaner chamber 6, the resonator chamber 7 and the first, second, third and fourth side branches 5*a*, 5*b*, 6*a* and 6*b*.

Although the embodiment of the present invention has been described in detail, it will be understood that the present invention is not limited to the above-described embodiment, and various modifications may be made without departing from the spirit and scope of the invention defined in the claims.

We claim:

1. An intake silencer device positioned upstream of a throttle body in an intake passage of an engine and having an air cleaner integrally coupled thereto, said intake silencer device comprising an expandable chamber, a first intake duct extending at one end thereof into said expandable chamber and communicating at the other end thereof with the atmosphere, an air cleaner chamber integrally formed with said expandable chamber, said air cleaner chamber including an air filter element therein, a second intake duct extending at one end thereof into said expandable chamber and extending at the other end thereof into said air cleaner chamber, a third intake duct extending at one end thereof into said air cleaner chamber and connected at the one end to said air filter element and at the other end thereof to the throttle body, and a resonator chamber integrally formed with said air cleaner chamber and communicating with said air cleaner chamber, wherein said expandable chamber and said resonator chamber are integrally formed on opposite sides of said air cleaner chamber, an opening at said one end of said first intake duct and an opening at said one end of said second intake duct being opposed to each other with a gap formed therebetween within said expandable chamber, and wherein an opening at the other end of said second intake duct is offset above and to one side of said air filter element within said air cleaner chamber, and the other end of said third intake duct is connected to said throttle body through an upper surface of said resonator chamber defined with its upper surface positioned at a lower level than said air cleaner chamber.

2. An intake silencer device according to claim 1, wherein each of said expandable chamber and said air cleaner chamber functions as an expandable silencer, and each of said first, second and third intake ducts extends into said expandable silencers, and said resonator chamber functions as a resonant silencer, wherein a total of seven silencing chambers are formed by said expandable silencers and the resonant silencers.

3. An intake silencer device according to claim 2, wherein said expandable chamber, said resonator chamber and said air cleaner chamber each include substantially pentagonal inner wall surfaces.

4. An intake silencer device according to claim 1, wherein said expandable chamber and said resonator chamber are vertically bisected and integrally formed by molding on opposite sides of said air cleaner chamber and wherein said silencer device includes a lower member having an open upper surface, an upper member having an open lower surface, and a seal member, said lower and upper members being coupled to each other with said seal member interposed therebetween.

5. An intake silencer device according to claim 4, including partition walls integrally formed by molding on said upper and lower members, wherein said expandable chamber and said air cleaner chamber are defined and separated from each other by said partition walls.

6. An intake silencer device according to claim 5, wherein said second intake duct includes a grooved flange around an outer periphery thereof, and is supported with said flange fitted into notches in said partition walls formed on said lower and upper members.

7. An intake silencer device according to claim 5, including notches formed in said partition walls in said lower and upper members, wherein said first and third intake ducts include grooved flanges around outer peripheries thereof, and are supported with said flanges fitted into said notches in said partition walls on said lower and upper members.

8. An intake silencer device according to claim 4, wherein said air filter element is formed into a truncated conical shape and is positioned obliquely to extend along a bottom wall of said lower member.

9. An intake silencer device according to claim 8, wherein the opening at said one end of said second intake duct is cut obliquely to face a triangular space defined between an upper portion of said air filter element and said upper member.

10. An intake silencer device according to claim 8, wherein said openings in said first and second intake duct positioned within said expandable chamber are axially aligned with each other and are positioned in an opposed relationship to each other.

11. An intake silencer device according to claim 10, wherein said first and second intake ducts are curved at substantially right angles within said expandable chamber, forming a space of a smaller volume defined inside curved portions of the ducts, and a space of a larger volume being defined outside the curved portions.

12. An intake silencer device according to claim 11, wherein said opening in said first intake duct and said opening in said second intake duct are obliquely formed, and the amount of the extension of said intake ducts into said expandable chamber is less on the inside of said curved portions and greater on the outside of said curved portions.

* * * * *